US007762491B2

(12) United States Patent
Schmalholz

(10) Patent No.: US 7,762,491 B2
(45) Date of Patent: Jul. 27, 2010

(54) BAND-WINDING METHOD

(75) Inventor: Peter Schmalholz, Voesendorf (AT)

(73) Assignee: Starlinger & Co Gesellschaft m.b.H., Vienna (AT)

( * ) Notice: Subject to any disclaimer, the term of this patent is extended or adjusted under 35 U.S.C. 154(b) by 819 days.

(21) Appl. No.: 10/557,752

(22) PCT Filed: May 10, 2004

(86) PCT No.: PCT/AT2004/000162

§ 371 (c)(1),
(2), (4) Date: Nov. 28, 2006

(87) PCT Pub. No.: WO2004/101415

PCT Pub. Date: Nov. 25, 2004

(65) Prior Publication Data

US 2007/0164145 A1 Jul. 19, 2007

(30) Foreign Application Priority Data

May 19, 2003 (AT) ..... A 770/2003

(51) Int. Cl.
*B65H 54/38* (2006.01)

(52) U.S. Cl. ..... 242/477.6; 242/477.8

(58) Field of Classification Search ..... 242/477.2, 242/477.3, 477.4, 477.5, 477.6, 477.7, 477.8
See application file for complete search history.

(56) References Cited

U.S. PATENT DOCUMENTS

| | | | | |
|---|---|---|---|---|
| 4,667,889 | A * | 5/1987 | Gerhartz | 242/477.6 |
| 5,439,184 | A * | 8/1995 | Poppinghaus et al. | 242/476.7 |
| 6,027,060 | A * | 2/2000 | Siepmann | 242/447.1 |
| 6,311,920 | B1 * | 11/2001 | Jennings et al. | 242/477.6 |

FOREIGN PATENT DOCUMENTS

| | | | |
|---|---|---|---|
| DE | 3920374 | A1 | 1/1991 |
| EP | 0194524 | A2 | 9/1986 |
| EP | 401781 | A1 * | 12/1990 |
| EP | 0561188 | A1 | 9/1993 |

OTHER PUBLICATIONS

Machine Translation of EP 0 401 781 A1.*

* cited by examiner

*Primary Examiner*—John Q Nguyen
*Assistant Examiner*—William E Dondero
(74) *Attorney, Agent, or Firm*—Townsend and Townsend and Crew, LLP

(57) ABSTRACT

In a process for winding a continuously supplied band (5) onto a bobbin (2), with the bobbin (2) being rotated and the band (5) being reciprocated along the entire length of the bobbin (2) at a winding angle (α) by means of a cross-winding device (4), each time the bobbin diameter has increased by a particular value, the winding ratio, i.e., the ratio between the number of bobbin rotations and the reciprocating motion (to-and-fro stroke) of the cross-winding device is stepwisely changed such that the winding ratio will change in essentially integral steps.

11 Claims, 4 Drawing Sheets

Winding ratios in the winding angle limit range of between 4° and 6°

BAND-WINDING METHOD

BACKGROUND OF THE INVENTION

The invention relates to a process for winding a continuously supplied band onto a bobbin, with the bobbin being rotated and the band being reciprocated along the entire length of the bobbin at a winding angle by means of a cross-winding device, wherein each time the bobbin diameter has increased by a particular value, the winding ratio, i.e. the ratio between the number of bobbin rotations and the reciprocating motion (to-and-fro stroke) of the cross-winding device, is changed in steps.

Among experts, such a process for winding a continuously supplied band is referred to as "stepped precision winding" and is known, for instance, from DE 41 12 768 A, DE 42 23 271 C1 and EP 0 561 188, the latter providing a detailed general account of various types of bobbin shapes.

The band is wound onto cylindrical or conical bobbin cores in winding machines, whereby the speed of supplying the band to the bobbin core is relatively constant, since it has been predetermined by band-manufacturing machines provided upstream of the winding machine.

The appearance, strength and quality of the bobbins is strongly affected by the following parameters:

1) The winding angle $\alpha$, which is the angle between a normal line to the axis of rotation of the bobbin and the longitudinal direction of the band supplied to the bobbin.
2) The winding ratio V, which is the number of bobbin rotations per to-and-fro stroke of the cross-winding device.

The winding angle $\alpha$ arises from the selected winding ratio V.

Stepped precision winding is a mixture of two basic winding methods of how to wind the supplied band onto a bobbin core, namely between "random winding" and "precision winding".

The characteristic feature of random winding is a constant winding angle $\alpha$ contrasted by a variable ratio between the number of bobbin rotations and the traverse speed (=variable winding ratio V). In the winding ratio/bobbin diameter chart of FIG. 2, three graphs are plotted for random windings with winding angles $\alpha$=4°, 5°, 6°. One advantage of random winding is the simple design of the winding machine necessary for its generation, which is illustrated in side view and top view in FIG. 3. In the most simple case, it may comprise a motor 10 actuating a driving roller 11 which, in turn, engages the periphery of the bobbin 12, driving the same at a constant peripheral speed so that the band 19 is wound up at a constant linear speed. The bobbin spindle 18 of the bobbin 12 may be configured so as to run freely. Via a transmission gear consisting of pulleys 15, 16 and a belt 17 running over the two pulleys, the motor 10 actuates a cross-winding device 13 in such a way that the traversing band guide 14, through which the band 19 passes, will reciprocate at a constant stroke speed (traverse stroke). Hence, there is a fixed transmission ratio between the peripheral speed of the bobbin 12 and the traverse stroke of the traversing band guide 14, resulting in a constant winding angle of the band 19 on the bobbin 12. This means that the winding angle at the beginning of the process of winding onto an empty bobbin core is the same as at the end of the winding process when the bobbin has reached its maximum diameter. Disadvantageously, the number of windings per winding layer thereby decreases steadily as the bobbin diameter increases so that a bobbin is created whose band material has a different packing density at every bobbin diameter. Another adverse effect occurring during winding, referred to as "pattern development", arises at certain ratios between bobbin diameters and traverse speeds, whereby, at those ratios, several layers of bandlets are superimposed almost exactly, thereby rendering the bobbin unstable. Therefore it is necessary to take measures to create "pattern interference", f.i. wobbling.

Precision winding, on the other hand, is characterized by a constant winding ratio along the entire increasing bobbin diameter, which in turn means that the winding angle will decrease as the bobbin diameter increases. In the chart of FIG. 2, a precision winding with a winding ratio V=35 is plotted as a straight line. The advantage of precision winding lies in achieving a bobbin whose band material has a constant packing density on the bobbin independently of the bobbin diameter. The disadvantage of precision winding is that—starting from an initial winding angle at the beginning of winding the band material onto an empty bobbin core—the winding angle gets smaller and smaller as the bobbin diameter increases and finally is so small (theoretically approaching zero) that the bobbin will become unstable. The design of a winding machine for generating a precision winding is illustrated in side view and top view in FIG. 4. The winding machine comprises a motor 20 rotating a bobbin spindle 21. A bobbin core 26 is fitted on the bobbin spindle 21 in torque-proof manner, on which core a band 27 is wound to form a bobbin 22. A cross-winding device 23 is connected with the bobbin spindle 21 via a spur gear 25. The cross-winding device 23 is equipped with rotation/translation converting means (not illustrated) for reciprocating the traversing band guide 24 in traverse strokes. By means of the direct rotary drive of the bobbin spindle 21, the rotational speed of the motor 20 must be steadily reduced as the diameter of the bobbin 22 being formed increases, since the band to be wound up is supplied by a band-manufacturing device at a constant linear speed.

So as to alleviate the respective disadvantages of random winding and precision winding and combine their advantages, the "stepped precision winding" was recommended in the past. The winding method is based on the concept that the winding ratio between predefined limiting diameters of a bobbin is kept constant and is changed in steps to a different value as soon as a respective limiting diameter has been reached, with the values of the winding ratios being chosen such that a graph of the winding ratio will roughly follow, across the bobbin diameter, the graph of a random winding for a particular winding angle. The advantage of stepped precision winding is that, on the one hand, "pattern development" is avoided since the volatile change of the winding ratio represents a "pattern interference measure".

On the other hand, the winding angle does not become substantially smaller than the initial winding angle even if the bobbin diameter increases.

While the stepped precision winding yields the expected good result for the manufacture of yarn and thread bobbins, surprisingly poor results are often achieved if band bobbins are produced by stepped precision winding. The inadequacies of those band bobbins range from an irregular and therefore unsightly optical appearance to bobbins with varying, f.i. corrugated, diameters throughout their lengths, from irregular spindle fronts to an unstable winding structure.

Since such bobbins are usually used in rapidly operating machines such as circular looms, each irregularity of the bobbin structure can have fatal results, which, as the smallest consequence, will result in the rupture of the band as it is drawn off from the bobbin and, in the worst case, will involve the destruction of a part of the machine. Such damages are caused by unbalanced masses at irregular bobbins, by vibrations in the bands that gradually build up as they are drawn off, etc. Furthermore, irregular bobbins will heat up rapidly if the bands are drawn off quickly, thus leading to fatigue and weakening of the band material, in particularly if the material is oriented plastic bands.

For that reason, a strong demand for an improved process of stepped precision winding exists in the industry.

SUMMARY OF THE INVENTION

The present invention provides such an improved process of stepped precision winding, characterized in that the winding ratio is changed stepwisely in essentially integral steps. The inventors have indeed discovered that the reason for an unsatisfactory bobbin structure during stepped precision winding lies in the sudden change in the layer pattern of the bands, caused by the stepwise change of the winding ratio and representing a point of discontinuity for the overall structure of the bobbin. In the worst-case scenario, those changed layer patterns will accumulate and lead to the above-mentioned irregularities or unequal packing densities. However, due to the measure according to the invention, the layer pattern will remain substantially unchanged even upon a stepwise change in the winding ratio so that a bobbin with an excellent structure, i.e. regular appearance and high packing density, will arise. A stepwise change in the winding ratio in essentially integral steps means that, with each change, the post-decimal point part of the winding ratio will change by 0.1 at the most, preferably 0.03 at the most, more preferably 0.01 at the most.

According to a preferred embodiment of the invention, with each change in the winding ratio, the post-decimal point part of the ratio is changed to such a degree that a constant partial overlap with an underlying band track will result, such as illustrated below by way of an example. In this way, a very stable bobbin structure is achieved.

If the winding ratio is integral, i.e. if the winding ratio has no decimal-point part, pattern development will occur on the bobbin. In order to eliminate such pattern development, which renders the bobbin structure unstable, it furthermore is suggested according to the invention that the winding ratios are chosen such that their post-decimal point parts are at least two-digit. Furthermore, it is preferred for bobbins with plastic bands that the winding ratios are chosen to be close to 0 or 0.50 or 0.33 or 0.25, whereby the reversal points of the band at the front side of the bobbin will end up lying close to each other again after one, two, three or four to-and-fro strokes of the traversing band guide. Depending on the width of the bands to be wound up, the winding ratio can be changed such that a forward- or backward-moving band winding is created or maintained, respectively.

Furthermore, certain winding angle ranges can be empirically specified for the respective widths of the bands and their material properties, which ranges provide for the best possible structure of the bobbin. In order to achieve this best possible bobbin structure, it is provided for the winding ratio to be changed such that the resulting winding angle will stay within the predetermined range. In case of oriented plastic bands with a width of between 2 and 10 mm, a winding angle range of 4 to 6° has proven to be advantageous, for instance.

In order to be able to adjust the winding ratios according to the invention with the required accuracy, it has proven to be beneficial if the bobbin is driven by a separate motor and the cross-winding device is also driven by a separate motor and the change in the winding ratio is performed electronically by stepwisely changing the ratio of the speeds of the two motors. Motors which are constructed as rotary-current drives with frequency converters or as direct-current drives can be controlled particularly well.

Furthermore, the instantaneous bobbin diameter can be calculated with great precision from a variance comparison of the linear band speed and the number of bobbin rotations.

By way of exemplary embodiments, the invention will now be explained in further detail with reference to the drawings.

DESCRIPTION OF THE PREFERRED EMBODIMENTS

Figure 1:
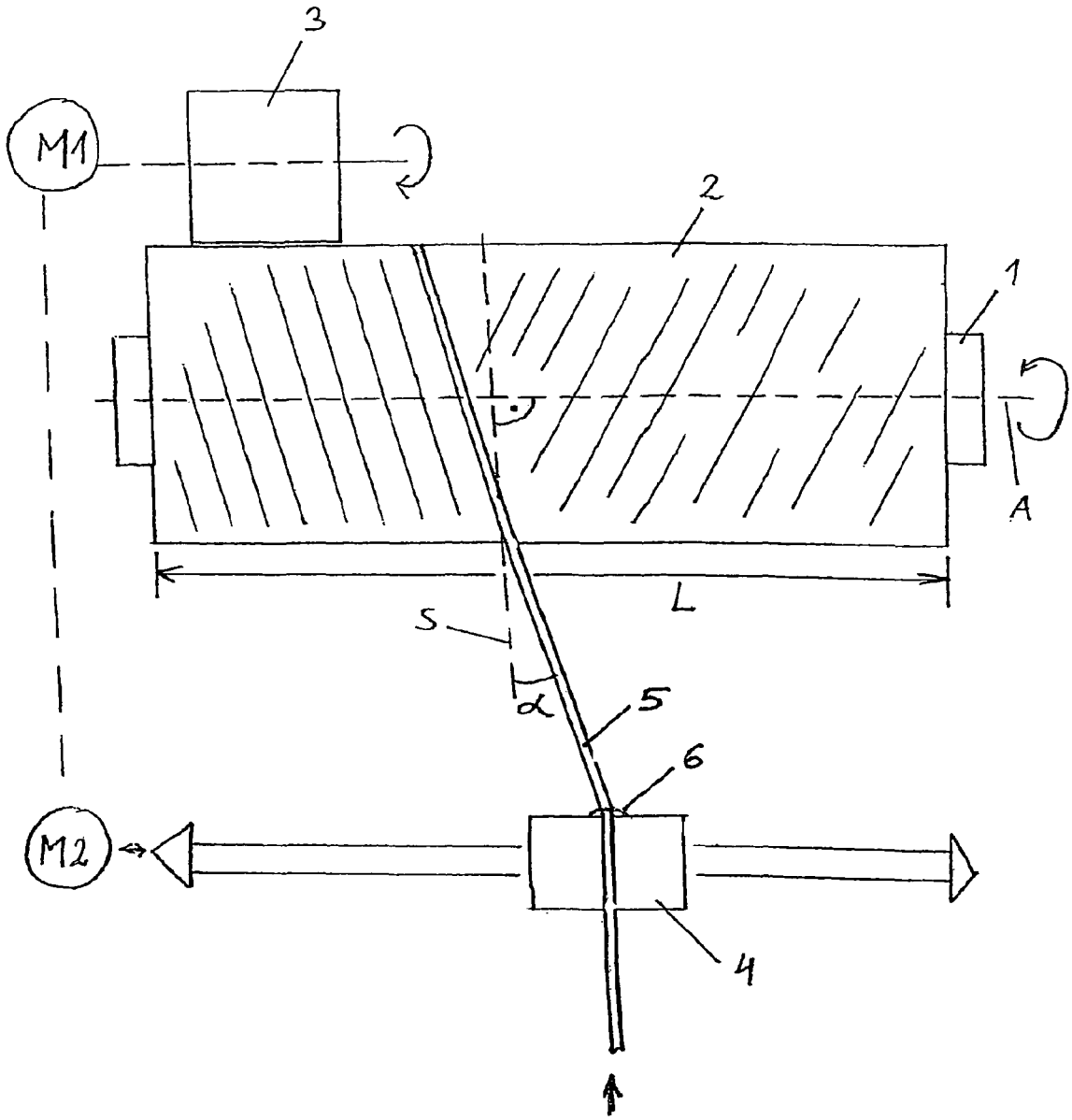
FIG. 1 shows the basic design of a winding machine for carrying out the process according to the invention.

A winding machine for carrying out the process according to the invention, as shown in simplified manner in FIG. 1, has at least one, usually however a plurality, of drivable bobbin spindles 1, in a rotary bearing. A bobbin core (not illustrated) is attached to the bobbin spindle 1 in torque-proof manner, onto which core the band material 5 is wound. The band material 5 is supplied from a band-manufacturing device at an essentially constant linear speed. Such band-manufacturing devices are known per se and are not part of the invention so that no further illustration is required. Each bobbin spindle 1 or the band bobbin 2 building up on the bobbin core, respectively, is rotated by a contact roller 3 rotatable around its own axis, which is driven by a motor M1 and is in peripheral contact with the bobbin 2. Furthermore, a cross-winding device 4 movable back and forth along the length of the bobbin spindle is provided, which has a lug-shaped traversing band guide 6 through which the band 5 passes and which supplies the band 5 to the bobbin 2 at a winding angle $\alpha$. Thereby, the winding angle $\alpha$ is defined as the angle between the supplied band 5 and a normal line S to the bobbin axis A. The winding length L is the axial length in which the band 5 is wound onto the bobbin spindle 1. In other words, the winding length L corresponds to the bobbin length, and two winding lengths make up the length of one to-and-fro stroke of the cross-winding device 4.

The winding machine is operated by a process of stepped precision winding. This means that, starting from an initial winding angle, at first a certain winding ratio is maintained when winding the band onto a bobbin core (thereby changing the winding angle). If the diameter of the bobbin reaches a predetermined value, the winding ratio will stepwisely be adjusted to a new value, which in turn will be maintained until the bobbin diameter has increased to another predetermined value, whereupon the winding ratio will again stepwisely be adjusted to a new value.

The winding ratio is adjusted by an "electronic gear", i.e. an electronic regulation of the ratio between the speeds of the motor M1 driving the bobbin 2 and of a motor M2 reciprocating the cross-winding device 4. Again and again, the virtual "transmission ratio" of the two motors is stepwisely changed electronically upon reaching a certain diameter by imparting a changed speed to the traverse drive M2. Preferably, the drives M1, M2 are rotary-current drives with frequency converters or direct-current drives.

The instantaneous bobbin diameter is calculated, for example, from a variance comparison of the linear thread speed and the number of bobbin rotations.

Figure 2:
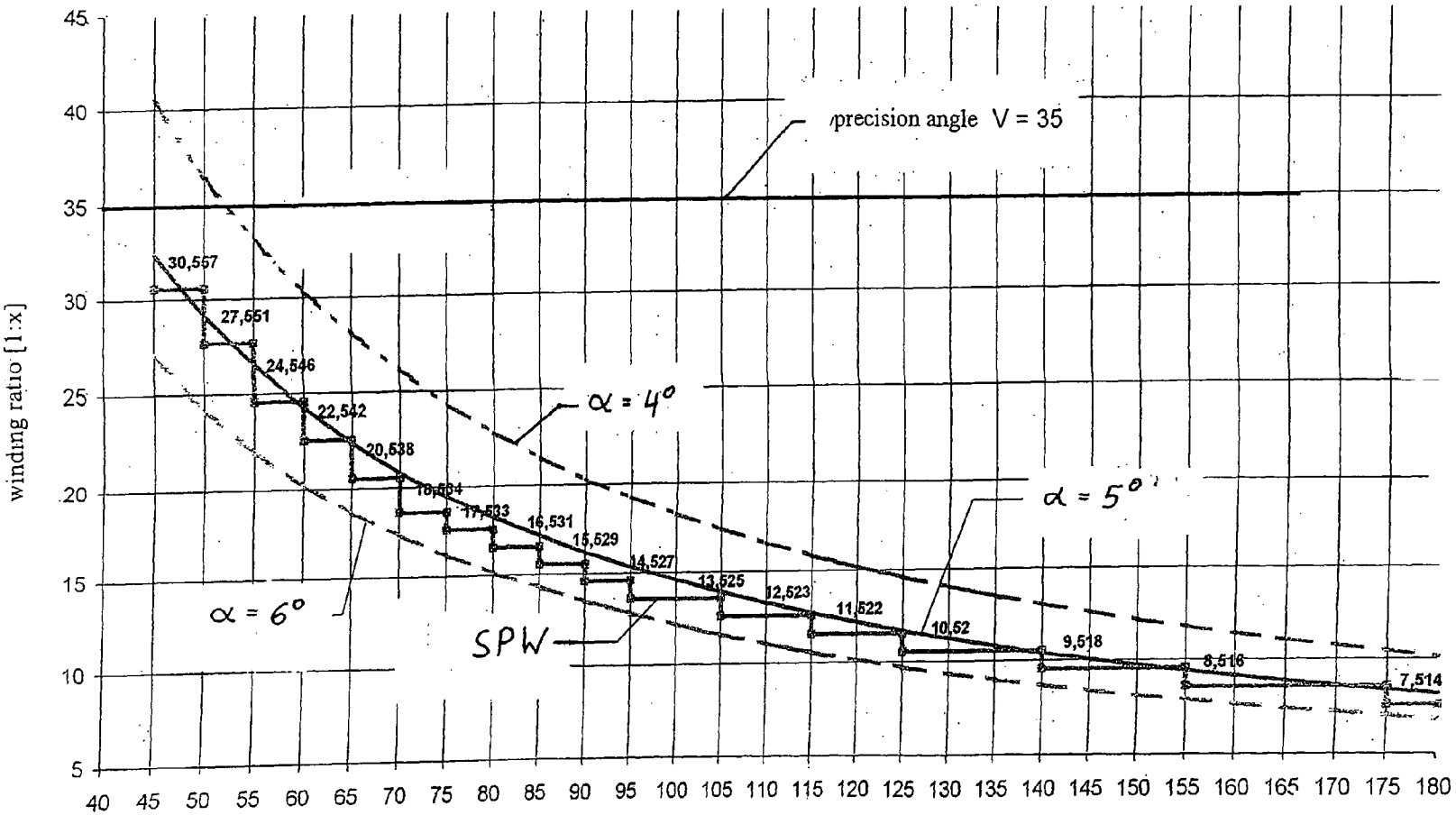
FIG. 2 shows a chart in which graphs of the winding ratio are plotted above the bobbin diameter for three random windings with winding angles $\alpha=4°$, $\alpha=5°$ and $\alpha=6°$, for a precision winding V=35 and for a stepped precision winding SPW.
Figure 3:
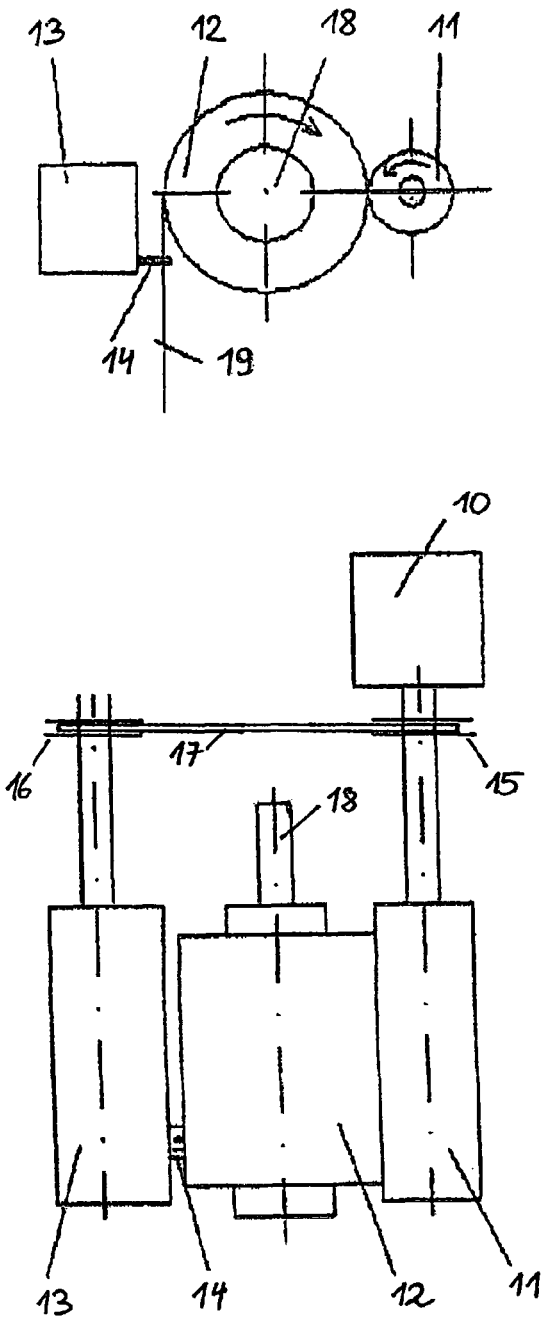
FIG. 3 shows the initially illustrated winding machine according to the prior art for generating a random winding.
Figure 4:
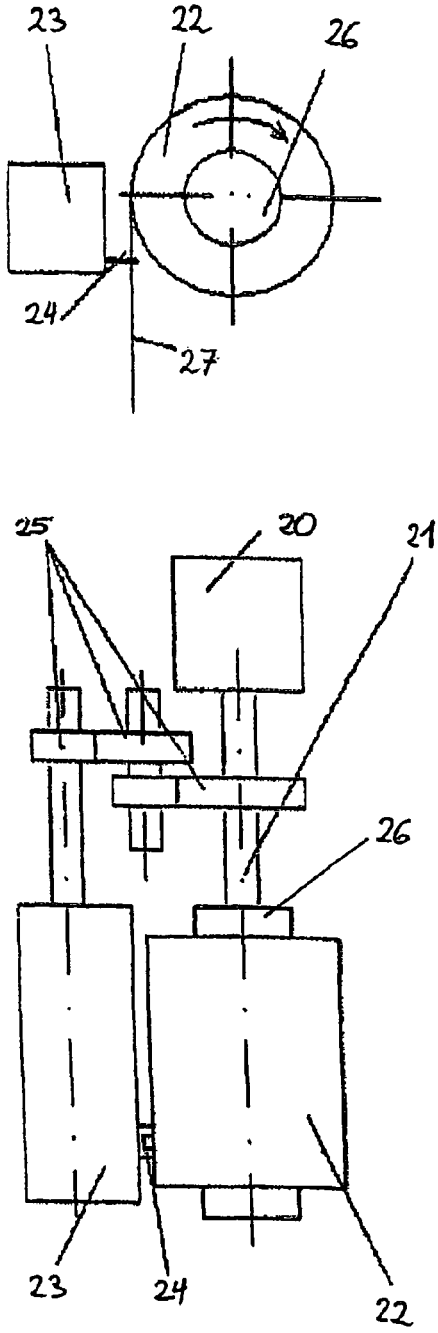
FIG. 4 shows the initially illustrated winding machine according to the prior art for generating a precision winding.

In the chart of FIG. 2, the graph SPW shows the progressive course of stepped precision winding, wherein, according to the invention, the winding ratio is changed stepwisely in essentially integral steps. Starting from the beginning of winding a band onto a bobbin core with a diameter of 45 mm, at first a predetermined winding ratio V=30.557 is maintained until the bobbin diameter reaches 50 mm, whereupon the winding ratio V is adjusted to 27.551 until the bobbin diameter reaches 55 mm, whereupon the winding ratio V is changed to 24.546. This stepwise change in the winding ratio occurs with every increase in the bobbin diameter by 5 mm, up to a diameter of 95 mm (V=13.525). From then on, the winding ratio is changed only upon every bobbin diameter increase of 10 mm, from a bobbin diameter of 125 mm it is changed only upon every bobbin diameter increase of 15 mm, and from a bobbin diameter of 155 mm it finally is changed only upon every bobbin diameter increase of 20 mm. From the chart of FIG. 2 it can be seen that the entire course of graph SPW stays within the limits set by the graphs of random windings with winding angles $\alpha=4°$ and $\alpha=6°$, respectively; i.e. the winding angle does indeed vary in a stepped precision winding but only within a small band width of between 4 and 6°. Actually, the course of the graph SPW roughly follows that of a random winding with $\alpha=5°$ but without as much as coinciding, if only in sections, with the graph or running in parallel with it, since in such a section the bobbin would exhibit the properties of a random winding with the associated problems of "pattern development". Table 1 shows the winding ratios of graph SPW, wherein, in column 1, the respective bobbin diameters are indicated at which the winding ratio is changed to the values that are indicated in column 2. Column 3 shows the pre-decimal point part of the winding ratio, which indicates how many complete rotations the bobbin performs per to-and-fro stroke of the cross-winding device. Column 4 shows the post-decimal point part of the winding ratio from which the shift angle as shown in column 6 can be calculated, which indicates by how many angular degrees the reversal point of the band has been displaced relative to the previous reversal point upon a to-and-fro stroke of the cross-winding device. Column 5, on the other hand, shows the post-decimal point difference between consecutive winding ratios. It can be seen that the post-decimal point difference is in the thousandth range; i.e. the changes in the winding ratio are performed essentially in whole numbers.

TABLE 1

| Bobbin diameter [mm] | Winding ratio | Pre-decimal point part | Post-decimal point part | Post-decimal point difference | Shift angle [°] |
|---|---|---|---|---|---|
| 45 | 30.557 | 30 | 0.557 | | 200.52 |
| 50 | 27.551 | 27 | 0.551 | 0.006 | 198.36 |
| 55 | 24.546 | 24 | 0.546 | 0.005 | 196.56 |
| 60 | 22.542 | 22 | 0.542 | 0.004 | 195.12 |
| 65 | 20.538 | 20 | 0.538 | 0.004 | 193.68 |
| 70 | 18.534 | 18 | 0.534 | 0.004 | 192.24 |
| 75 | 17.533 | 17 | 0.533 | 0.001 | 191.88 |
| 80 | 16.531 | 16 | 0.531 | 0.002 | 191.16 |
| 85 | 15.529 | 15 | 0.529 | 0.004 | 190.44 |
| 90 | 14.527 | 14 | 0.527 | 0.002 | 189.72 |

TABLE 1-continued

| Bobbin diameter [mm] | Winding ratio | Pre-decimal point part | Post-decimal point part | Post-decimal point difference | Shift angle [°] |
|---|---|---|---|---|---|
| 95 | 13.525 | 13 | 0.525 | 0.002 | 189 |
| 105 | 12.523 | 12 | 0.523 | 0.002 | 188.28 |
| 115 | 11.522 | 11 | 0.522 | 0.001 | 187.92 |
| 125 | 10.52 | 10 | 0.52 | 0.002 | 187.2 |
| 140 | 9.518 | 9 | 0.518 | 0.002 | 186.48 |
| 155 | 8.516 | 8 | 0.516 | 0.002 | 185.76 |
| 175 | 7.514 | 7 | 0.514 | 0.002 | 185.04 |

Figure 5:
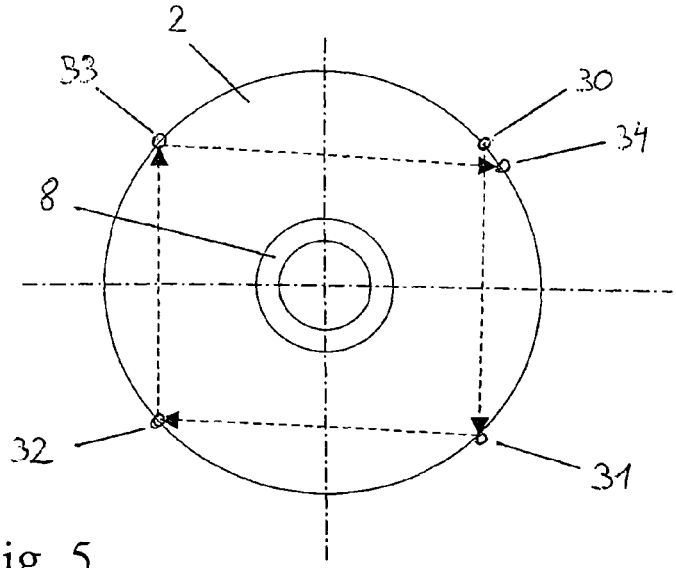
FIG. 5 shows the position of reversal points of the band material at the front side of a bobbin.

In order to eliminate "pattern development", the post-decimal point part of all winding ratios is chosen such that in each case at least two decimal places are provided; actually, the winding ratios exhibit even three decimal places except in the area where the bobbin diameter amounts to 125 mm. The post-decimal point part is close to 0.5 (actually between 0.557 and 0.514) so that the reversal point of the band will end up lying close to the previous reversal point again after two to-and-fro strokes of the cross-winding device. Further preferred value ranges of the post-decimal point part of the winding ratio are close to 0 or 0.33 or 0.25. However, none of those values should themselves be applied, since, in such case, pattern development would occur at every to-and-fro stroke or after three or four to-and-fro strokes of the cross-winding device, respectively. For a better understanding of the correlation between the post-decimal point part of the winding ratio and the shift angle, a bobbin 2 is schematically illustrated in front view in FIG. 5, which bobbin consists of a band material that is wound onto a bobbin core 8 with a winding ratio that exhibits a post-decimal point part of slightly more than 0.25, f.i. 0.26. From this, a shift angle of slightly more than 90° can be calculated. Starting from point 30 which represents a reversal point of a band winding, the band material is deposited on the bobbin with every to-and-fro stroke of the cross-winding device in such a way that the reversal point will shift by about 90° on the bobbin circumference, thereby creating a sequence of reversal points 30→31→32 →33→34 such as illustrated by the broken arrows. It can be seen that the reversal point 34 is close to the reversal point 30; i.e. after four to-and-fro strokes of the cross-winding device the band layers will end up lying next to each other.

Figure 6:
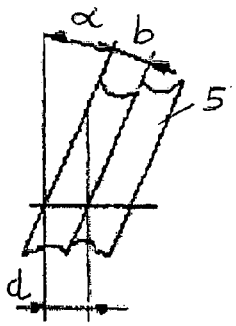
FIG. 6 to FIG. 9 show various configurations of superimposed band tracks.
Figure 7:
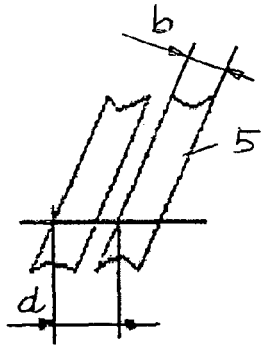
Figure 8:
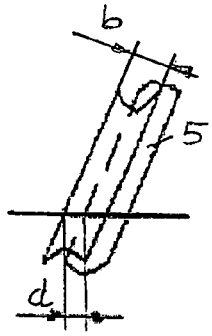
Figure 9:
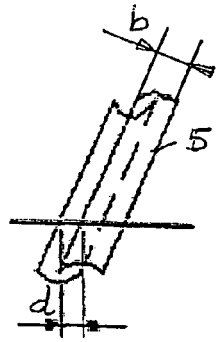

Furthermore, it is preferred that the winding ratio is adjusted such in each case that a constant partial overlap of the band to be wound up with an underlying band track will result. If bands are wound onto bobbins, the following configurations of superimposed band tracks as illustrated in FIGS. 6 to 9 can emerge. Apart from the winding ratio, those configurations depend on the winding angle $\alpha$, the width b of the bands 5 and their axial shift d. In FIG. 6, the bands lie exactly edge on edge. In FIG. 7, the bands lie spaced apart. In FIG. 8 and FIG. 9, the band tracks partially overlap such as preferred according to the invention. In FIG. 8 this creates a backward-moving winding of band material and in FIG. 9 a forward-moving winding of band material.

In a preferred embodiment of the winding process according to the invention, each time the winding ratio is changed, the post-decimal point part of the ratio will be changed to such a degree that a constant partial overlap with an underlying band track will result. The ratio between the axial shift d and the winding ratio V can be determined from the following formula:

$$V = \frac{n_a \times 2L \times (V_z + 1/n_a)}{n_a \times 2L - d}$$

wherein the following applies:

V=winding ratio (f.i. rounded to four decimal places)

Vz=winding-ratio number (integral, selected pre-decimal point part of winding ratio V)

na=tie number (integral, number of to-and-fro strokes at which the defined shift d is supposed to occur)

L=winding length of the bobbin in mm (2L→to-and-fro stroke)

d=shift in mm (along the winding axis).

By means of the above-indicated formula, a person skilled in the art is able to determine, from a desired shift d, the winding ratio V that is necessary therefor. In practice, it has turned out to be advantageous for the design of a bobbin with excellent stability that the shift d is selected such that an overlap of bandlets of approximately ½ a bandlet width b emerges (see FIG. 8 and FIG. 9). A negative algebraic sign of the shift means a "forward-moving" winding.

Figure 10:
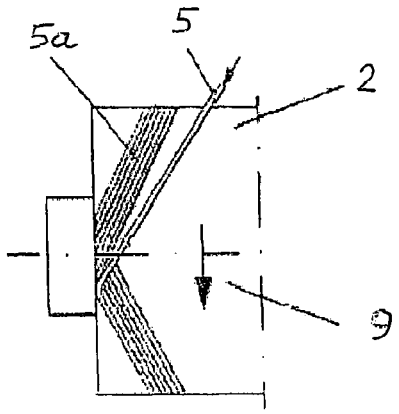
FIG. 10 and FIG. 11 show a forward-moving and backward-moving winding of band material, respectively.
Figure 11:
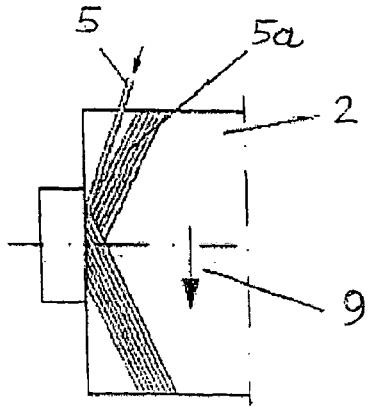

In case of a "forward-moving" winding of the band material, the band 5 being wound onto the bobbin 2 is deposited in front of the band material 5*a* located on the bobbin 2 which rotates in the direction of arrow 9, such as illustrated in FIG. 10. In case of a "backward-moving" winding of the band material, the band 5 being wound onto the bobbin 2 is deposited behind the band material 5*a* located on the bobbin 2 which rotates in the direction of arrow 9, such as illustrated in FIG. 11. However, a forward- and backward-moving winding of the band material does not only affect adjacent layers. According to the invention, it is also preferred that, upon reaching a diameter limit, the winding ratio is always changed in such a way that, with this stepwise change, a forward- or backward-moving winding of band material is likewise created or maintained. This also means that the change in the shift angle is performed such that the shift angle will either become increasingly larger or—such as indicated in table 1—smaller and smaller, thereby contributing to a particularly regular bobbin structure.

The above-indicated formula may also be rephrased such that the shift d can be calculated based upon a winding ratio that is known as:

$$d = n_a \times 2L - \frac{n_a \times 2L \times (Vz + 1/n_a)}{V}$$

The invention claimed is:

1. A process for winding a continuously supplied band (5) onto a bobbin (2), with the bobbin (2) being rotated and the band (5) being reciprocated along the entire length of the bobbin (2) at a winding angle (α) by means of a cross-winding device (4), wherein each time the bobbin diameter has increased by a particular value, the winding ratio, i.e. the ratio between the number of bobbin rotations and the reciprocating motion (to-and-fro stroke) of the cross-winding device, is changed in steps, wherein the bobbin (2) is driven by a separate motor (M1) and the cross-winding device (4) is also driven by a separate motor (M2) and the change in the winding ratio is performed electronically by stepwisely changing the ratio of the speeds of the two motors and that, with the stepwise change, the winding ratio is changed in essentially integral steps so that, with each change, the post-decimal point part of the winding ratio will change by 0.1 at the most.

2. A winding process according to claim 1, wherein, with each change in the winding ratio, the post-decimal point part of said ratio is changed to such a degree that a constant partial overlap with an underlying band track will result, wherein an axial shift d to the extent of the desired constant partial overlap is selected and the winding ratio is calculated from the following formula:

$$V = \frac{na \times 2L \times (Vz + 1/na)}{na \times 2L - d}$$

wherein the following applies:

V=winding ratio (f.i. rounded to four decimal places)

Vz=winding-ratio number (integral, selected pre-decimal point part of winding ratio V)

na=tie number (integral, number of to-and-fro strokes at which the defined shift d is supposed to occur)

L=winding length of the bobbin in mm (2L→to-and-fro stroke)

d=shift in mm (along the winding axis).

3. A winding process according to claim 2, wherein, depending on the winding angle (α), the shift d is selected such that an overlap of bands of approximately ½ a bandlet width b emerges.

4. A winding process according to claim 1, wherein the post-decimal point part of the winding ratio is at least two-digit.

5. A winding process according to claim 4, wherein the post-decimal point part of the winding ratio is close to 0 or 0.50 or 0.33 or 0.25.

6. A winding process according to claim 1, wherein the winding ratio is changed such that a forward- or backward-moving band winding is created.

7. A winding process according to claim 1, wherein the winding ratio is changed such that the resulting winding angle (α) will stay within a predetermined band width.

8. A winding process according to claim 1, wherein the motors (M1, M2) are rotary-current drives with frequency converters or direct-current drives.

9. A winding process according to claim 1, wherein the instantaneous bobbin diameter is calculated from a variance comparison of the linear band speed and the number of bobbin rotations.

10. A winding process according to claim 1, wherein with each change, the post-decimal point part of the winding ratio will change by 0.03 at the most.

11. A winding process according to claim 1, wherein with each change, the post-decimal point part of the winding ratio will change by 0.01 at the most.

* * * * *